United States Patent [19]

Onishi

[11] 4,347,950

[45] Sep. 7, 1982

[54] PACKING MACHINE WITH APPARATUS FOR AUTOMATICALLY STOPPING BAG MATERIAL TRANSFER ROLLERS

[75] Inventor: Masami Onishi, Tokyo, Japan

[73] Assignee: Taiyo Shokai Co., Ltd., Japan

[21] Appl. No.: 187,063

[22] Filed: Sep. 15, 1980

[30] Foreign Application Priority Data

Sep. 17, 1979 [JP] Japan ..... 54-126903[U]

[51] Int. Cl.[3] ..... B65G 59/00

[52] U.S. Cl. ..... 221/13; 221/15; 221/21; 221/25; 225/11

[58] Field of Search ..... 221/9, 13, 15, 21, 25; 225/11, 14, 15, 23, 80

[56] References Cited

U.S. PATENT DOCUMENTS 3,246,797 4/1966 Hoenisch ..... 221/13

*Primary Examiner*—Joseph J. Rolla

*Attorney, Agent, or Firm*—McGlew and Tuttle

[57] ABSTRACT

A packing machine is disclosed in which an apparatus for automatically stopping a pair of intermittently operated pinching rollers for transferring a strip-like plastics bag material is provided. The apparatus is a kind of emergency stop and is arranged to be automatically operated in case the bag material loaded in the machine has been broken.

1 Claim, 5 Drawing Figures

PACKING MACHINE WITH APPARATUS FOR AUTOMATICALLY STOPPING BAG MATERIAL TRANSFER ROLLERS

BACKGROUND OF THE INVENTION

The present invention relates to a packing machine of the type which performs a packing operation by intermittently conveying a strip-like bag material which comprises a series of interconnected plastic bags, by filling desired goods into a leading bag section of the strip-like bag material, by heat-sealing the bag section and by separating the sealed bag section from a subsequent bag section of the bag material.

The strip-like bag material which is usually used in packing machines of the type described above has a structure as illustrated in FIG. 1. The illustrated strip-like bag material F comprises a series of interconnected bag sections B which are formed by heat-sealing a collapsed plastics film tube transversely across the same at regular intervals so as to form their respective bottoms 1 and by heat-cutting one side of the tube transversely across the same so as to form their respective opening portions 2 along and adjacent to the bottoms 1, whereby flap-like margins 3 of the welded portions 1 are formed transversely across the bag material F between the opening portions 2 and the welded portions 1, respectively. Further, the bag material F is provided, at the other side thereof, with easily severable rectilinear fragile portions 4 which are formed across the breadth of said bag material at the other side thereof at portions opposite to the opening portions 2, respectively. In the illustrated embodiment, each of the rectilinear fragile portions 4 takes the form of a row of perforations formed in the other side.

Usually, in conventional packing machines of the type described above, packing operation is performed in the following manner by the use of the strip-like bag material F. First, the bag material F is pinched between a pair of intermittently operated pinching rollers after being passed over guide rollers in such a way that its leading end depends from the pinching rollers. Then the bag material F is conveyed, by actuating the pinching rollers, for a distance corresponding to the length of one single bag so as to locate the opening portion 2 of the foremost bag section B between a pair of heat-sealers, then during inoperative interval of the drag rollers, the foremost bag B is inflated by actuating an air blower so that goods can be smoothly filled into the foremost bag B through a hopper and then after the goods have been filled therein, operation of the blower is stopped and the bag is sealed along its opening portion 2 by means of the heat-sealers and finally, the goods-charged bag is separated from the subsequent bag B of the bag material F. Thereafter, such packing operation is repeated by operating the pinching rollers.

As previously described, as the strip-like bag material F is formed with easily severable rectilinear fragile portions 4, when it is pulled by the intermittently operated drag rollers for movement, it may sometimes occur that the bag material F is caused to be broken and separated at one of the fragile portions 4 by the strain or tension imparted to it between a roll support and the drag rollers. Such accident may also occur from other causes during operation of the packing machine of the type described above.

In conventional machines of this kind, if and when such accident has happened, all of the interconnected bag sections B between the fragile portion 4 at which the bag material F has been broken and the leading end thereof become useless, since even if such accident has occurred, the drag rollers are kept operated, causing such bag sections to be discharged out of the machine, and in addition, preparation of operation of the machine, including loading of the bag material F, must be done again, which is not only troublesome, but also consumes considerable time and labor.

SUMMARY OF THE INVENTION

The present invention is intended to eliminate the drawbacks and inconveniences indicated with the conventional packing machines and to provide an improved packing machine which is provided with an apparatus for automatically stopping the pinching or drag rollers for transferring the strip-like plastics bag material which is arranged to be automatically operated in the event that the bag material loaded in the machine has been accidentally broken and separated during operation of the same.

Other objects and advantageous features of the present invention will become apparent from the following description taken in conjunction with the accompanying drawings.

DESCRIPTION OF THE PREFERRED EMBODIMENT

Like portions or parts are indicated by like numerals and characters throughout the specification and drawings.

Figure 1:
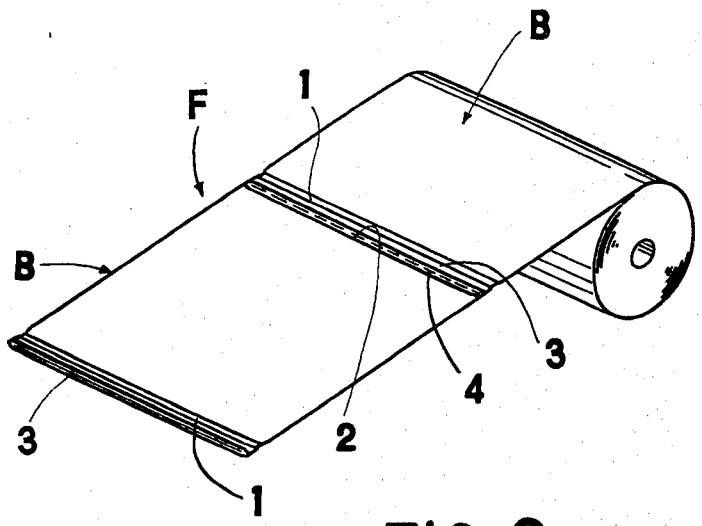
FIG. 1 is a perspective view of the strip-like bag material for use in the machine of the present invention in its rolled condition.
Figure 2:
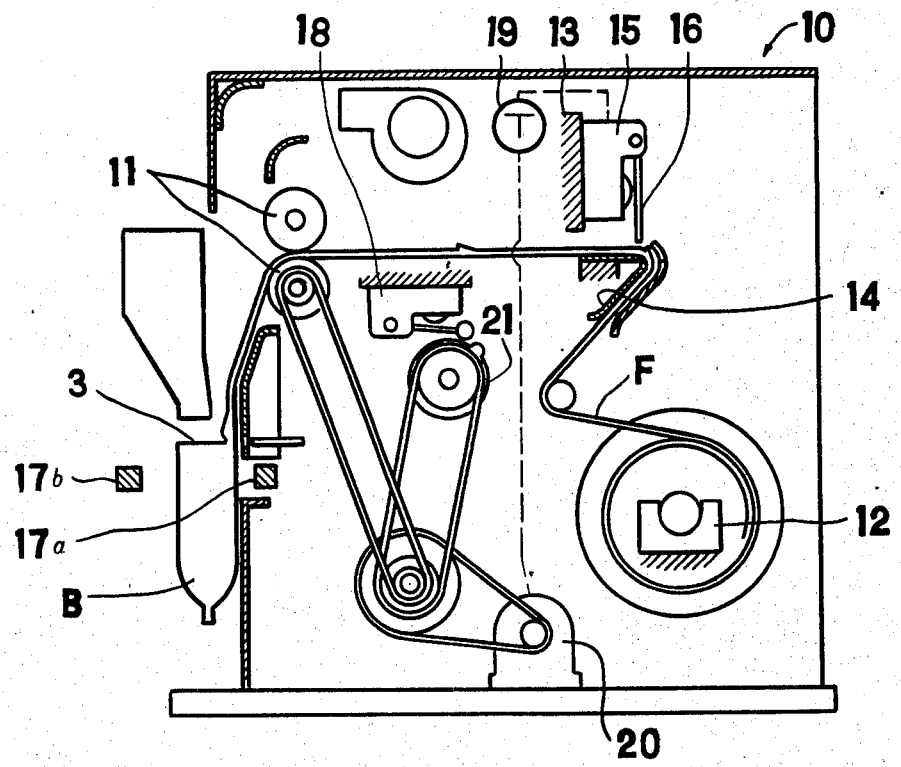
FIG. 2 is a schematic side view of the packing machine of the present invention.

Referring now to FIG. 2, there is shown a packing machine 10 which is provided with a pair of intermittently operated pinching rollers 11 extending horizontally and adapted to transfer a strip-like plastics bag material F for a distance at a time corresponding to the length of a single bag B. Under the pinching rollers 11 there is provided a pair of heat-sealers 17*a* and 17*b*. One 17*a* of the heat-sealers is fixedly mounted on the frame 13 of the machine 10, while the other 17*b* of the heat-sealers is displaceably mounted to move toward and away from the one heat-sealer 17*a*.

A guide means 14 in the form of a roller or a plate having a substantially V-shaped cross-section for guiding the bag material F is provided in the packing machine 10. The guide means 14 is located at an intermediate position of the travel path of the strip-like bag material F upstream of the rollers 11 between a roll support 12 and the rollers 11.

Figure 3:
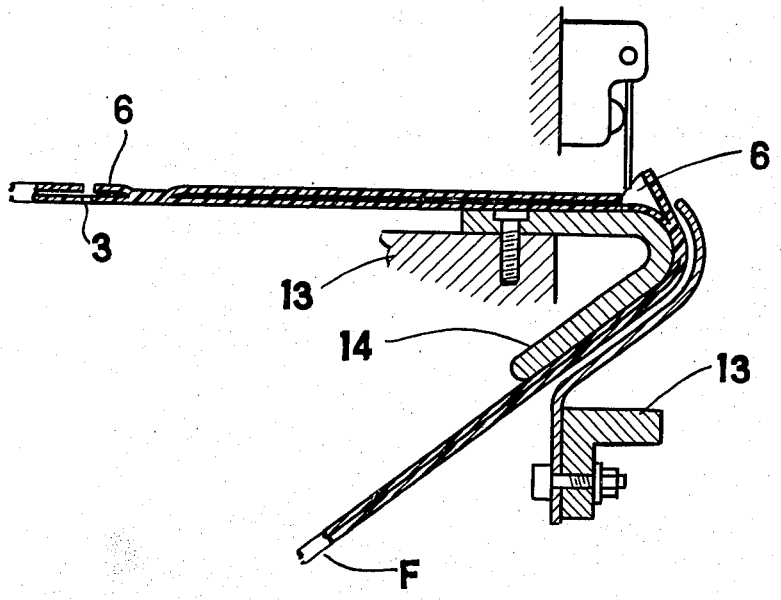
FIG. 3 is an enlarged schematic side view illustrating the state in which a limit switch as a detecting means is operated by the flap-like margin of the welded bottom portion of one of the bag sections of the bag material.

As shown in FIG. 3, the guide means 14 is mounted to carry thereon the bag material F such that each of the opening portions 2 of the respective bags B is directed outwardly of the guide means 14 when passing over the same. As shown in FIG. 3, the guide means 14 is a plate having a V-shaped cross-section with a first leg and a second leg from which the first leg is depended, the second leg having a surface for carrying the bag material received from the first leg. Accordingly, the free end of flap-like margin 3 is caused to be raised slightly above the surface of one side of the bag section as it travels over the guide means 14, as illustrated in FIG. 3.

In the vicinity of the guide means 14, there is provided a limit switch 15 having an elongated contact 16 which is arranged to be releasably engaged with the margin 3, as the latter passes over and is raised by the guide means 14. As the contact 16 engages the raised margin, the limit switch 15 is closed thereby and transmits a signal of detection of the welded portion 1 which forms the bottom of a bag B.

As such signal is received by a control device from the switch 15, rotation of a motor 20 for driving the pinching rollers 11 is stopped. In case where an electromagnetic clutch is incorporated between the motor 20 and the pinching rollers 11, said clutch is caused to be released in response to the signal to stop rotation of the rollers 11. In either case, as rotation of the rollers 11 is stopped, travel of the bag material F is also stopped.

As the bag material F is stopped in response to the detection of the bottom of a bag section B by the limit switch 15, sequential operations are performed by the packing machine 10 that comprise blowing by an air blower, filling goods into the expanded bag section, sealing the goods-charged bag section along the opening portion 2 by heat-sealers 17*a*, 17*b* and separating the sealed bag section from the subsequent bag section at the row of perforations 4. Then after completion of the above sequential operations, the pinching rollers 11 are driven again for the next packing operation.

Indicated by reference numeral 18 in FIG. 2 is another limit switch which is arranged to transmit a signal when the aforementioned sequential operations have been completed. This signal causes the drag rollers 11 to be operated so as to move the bag material and also causes a timer 19, which is provided on the machine 10, to start operating. The timer 19 is constructed so that it can be activated longer than the time T required for each intermittent travel of the bag material F for the distance corresponding to the length of a single bag section B. Preferably, the timer 19 is of the structure which is capable of varying time t to be set. The timer 19 is to be set each time so that it may cease its operation during each inoperative interval of the drag rollers 11.

When it is desired to operate the packing machine 10, first, the leading portion of the rolled bag material F supported on the roll support 12 is drawn and nipped between the pair of rollers 11 after being passed over the guide means 14 so that the flap-like margins 3 may be engaged with the contact 16 of limit switch 15 which extends into the path of travel of the bag material F. Then, as a main switch is turned on, the motor 20 starts rotating to drive the drag rollers 11 so as to convey the bag material nipped therebetween, and at the same time, the timer 19 is actuated. And then as the contact 16 engages the flap-like margin 3, the limit switch 15 signals detection of the bottom 1 of a single bag B, causing the rollers 11 to be stopped within the time t set. If the rollers 11 are connected to the motor 20 through the medium of an electromagnetic clutch, the clutch is released to stop the rollers 11 in response to the signal. On the other hand, if a one-way clutch is incorporated between the motor and the rollers, the signal will cause the motor 20 to be stopped or to be reversed. Thus, in normal condition, the bag material F is moved for a certain distance at a time corresponding to the length of a single bag B within the time t set by the timer 19.

However, if and when the bag material F is broken, the rollers 11 are caused to be stopped immediately after the time t set has expired in response to the signal transmitted by the timer 19, thereby causing travel of the bag material F to be stopped. In this case, if and when breakaway of the bag material F occurs at a position between the rollers 11 and the roll support 12 and the time t set expires before the breakage, i.e., the tail end of the foregoing part reaches the rollers 11, the foregoing part having a plurality of bag sections B remains nipped between the rollers 11. In such a case, operation of the machine can be easily resumed by connecting the tail end with the leading end of the other part of bag material by means of an adhesive tape.

It is to be noted that the aforementioned emergency stop can also work in the event that the bag material F does not move for some cause. For instance, it occurs that the rollers 11 run idle when the part of the bag material between the rollers 11 and the roll support 12 is strained. Even in such a case, the rollers 11 are caused to be stopped when the time t set expires.

Figure 4:
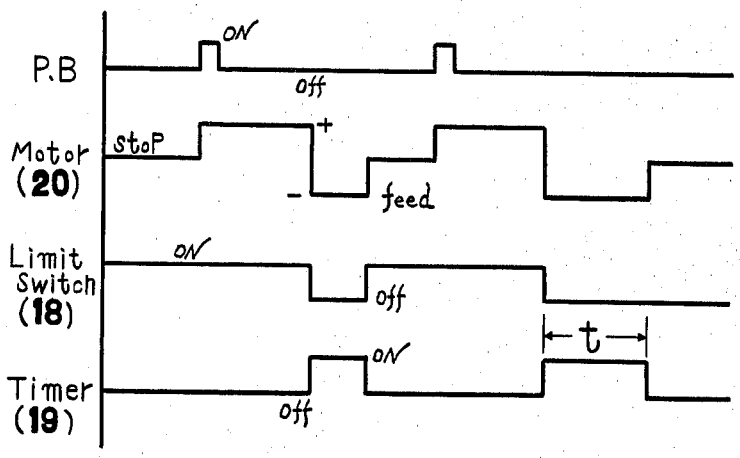
FIG. 4 is a time chart, illustrating the process of operation of the packing machine.
Figure 5:
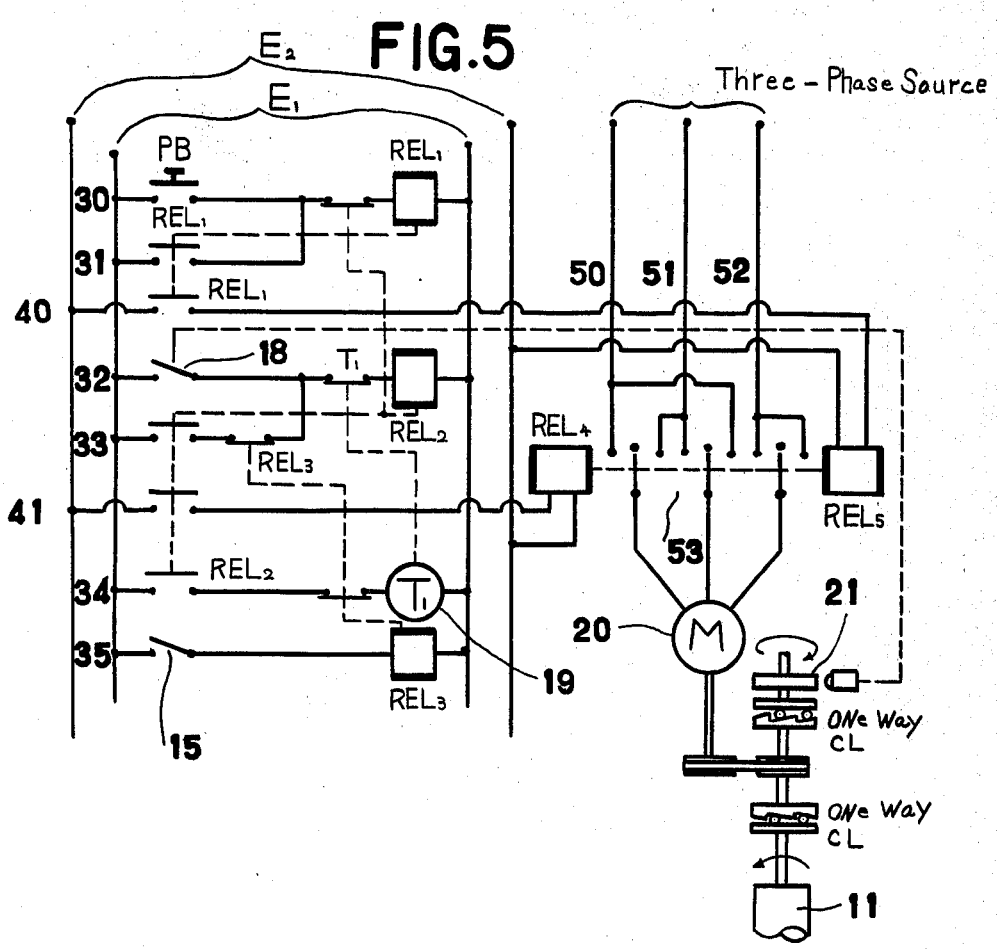
FIG. 5 is a diagrammatic representation of an electric circuit employed in the packing machine.

The interrelationship between limit switch 15, timer 19 and motor 20 and one embodiment of the electric control device are diagrammatically shown in FIGS. 4 and 5.

When limit switch 15 of No. 35 is in ON position, relay 3 is energized, relay 3 of No. 34 and relay 3 of No. 33 are in OFF position, relay 2 of No. 33 is de-energized, relay 2 of No. 41 is in OFF position, relay 4 of No. 41 is de-energized and motor 20 is inoperative.

As starter switch PB is turned to ON position, relay 2 of No. 30 is energized, relay 1 of No. 40 is in ON position, relay 5 is energized, switch 53 is in ON position, motor 20 is rotated, sequential operations including packing of goods heat-sealing of a bag and separation of the bag are performed. A signal for actuating rollers 11 is transmitted by closing limit switch 18 of No. 32 by means of a cam 21, relay 2 of No. 32 is energized, relay 2 of No. 41 is turned to ON, relay 2 of No. 30 is turned to OFF, relay 5 is de-energized, relay 4 is energized, motor switch 53 is switch to relay 4, motor 20 is reversed, rollers 11 starts rotating, limit switch 15 of No. 35 is opened by travel of bag material F, relay 3 of No. 35 is de-energized, relay 3 of No. 33 is turned ON, relay 2 is held and timer T1 is actuated.

Next, as limit switch 15 of No. 35 is turned to ON, relay 3 of No. 35 is energized, relays of Nos. 33, 34 and 41 are turned to OFF, motor 20 is stopped and timer 19 is reset.

If limit switch 15 is not turned to ON during rotation of rollers 11, the time t set by timer 19 of No. 34 is to expire, contact T1 is turned to OFF, relay 2 of No. 32 is de-energized, relays 2 of Nos. 33, 34 and 41 are turned to OFF and motor 20 is stopped.

It should be noted that the circuit shown is only an example and may be modified.

What I claim is:

1. A packing machine comprising a pair of intermittently operated pinching rollers for intermittently transferring an elongated strip-like bag material of a collapsed plastic film tube, said bag material comprising a series of interconnected bags each having a heat-sealed bottom portion and an opposite opening portion, each bag of said tube having a flap-like margin formed transversely across the bag material between said opening portion and said heat-sealed bottom portion, guide means mounted upstream of said pinching rollers for guiding the bag material through a travel path, said guide means comprising a plate having a V-shaped cross-section having a first leg and a second leg from which said first leg is depended, said second leg having a surface for supporting said bag material so that the respective opening portion of the bag material is directed outwardly of said guide means and said flap-like margin is caused to be raised slightly above the surface when passing over the same, detecting means for detecting said flap-like portion, said detecting means comprising a limit switch having an elongated contact mounted adjacent the surface of said guide means, said contact being releasably engageable with said margin responsive to the raising of said margin above the surface, means for stopping movement of said bag material in response to detection by said detecting means of said flap-like portion, and timer means for stopping rotation of said rollers, said timer means being constructed so that it can be activated longer than the time required for each intermittent travel of the bag material for a distance corresponding to the length of a single bag section.

* * * * *